US005980027A

United States Patent [19]

Yoshimura

[11] Patent Number: 5,980,027

[45] **Date of Patent: *Nov. 9, 1999**

[54] INK JET PRINT HEAD INCLUDING ADHESIVE LAYERS ENABLING OPTIMAL ELECTRODE COVERAGE AND INK DROPLET VELOCITY

[75] Inventor: Manabu Yoshimura, Nagoya, Japan

[73] Assignee: Brother Kogyo Kabushiki Kaisha, Nagoya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/751,763

[22] Filed: Nov. 8, 1996

[30] Foreign Application Priority Data

Nov. 10, 1995 [JP] Japan ..... 7-317420

[51] Int. Cl.[6] ..... B41J 2/045

[52] U.S. Cl. ..... 347/68; 347/69

[58] Field of Search ..... 347/69, 68, 71

[56] References Cited

U.S. PATENT DOCUMENTS 4,879,568 11/1989 Bartky et al. ..... 347/69 X 5,400,064 3/1995 Pies et al. ..... 347/69

5,477,247 12/1995 Kanegae ..... 347/71

FOREIGN PATENT DOCUMENTS 6-155738 6/1994 Japan ..... 347/69

6-182991 7/1994 Japan ..... 347/69

*Primary Examiner*—John Barlow

*Assistant Examiner*—C. Dickens

*Attorney, Agent, or Firm*—Oliff & Berridge, PLC

[57] ABSTRACT

Piezoelectric elements forming actuators of an ink jet print head are bonded together by an adhesive layer having a thickness in a predetermined thickness range to obtain good coverage of electrodes formed on the side walls of the actuators. The adhesive layer for bonding together two types of piezoelectric elements forming the side wall has a small thickness enabling the electrodes to cover a percentage of each side wall not lower than a predetermined value. Therefore, the electrodes extending across the two types of piezoelectric elements will not be disconnected, desired characteristics of the actuators can be secured, and the jetting performance of the ink jet print head will not deteriorate.

12 Claims, 5 Drawing Sheets

INK JET PRINT HEAD INCLUDING ADHESIVE LAYERS ENABLING OPTIMAL ELECTRODE COVERAGE AND INK DROPLET VELOCITY

BACKGROUND OF THE INVENTION

1. Field of the Invention

The present invention relates to an ink jet print head employing actuators, such as piezoelectric elements, intended for use on an ink jet recording apparatus that jets ink droplets for printing.

2. Description of Related Art

A prior art ink jet head disclosed in, for example, Japanese Examined Patent Publication No. Hei 6-61936 comprises: nozzles through which ink droplets are jetted; pressure chambers communicating with the nozzles, respectively, to supply a liquid to be jetted to the nozzles; actuators each comprising two types of piezoelectric elements polarized in opposite polarities and forming the side walls of the pressure chambers, and electrodes formed on the side walls to apply an electric field perpendicular to the direction of polarization to the side walls; and an ink supply for supplying ink into the pressure chambers. When a voltage is applied across the electrodes of the actuator, the piezoelectric elements forming the side walls undergo shear deformation, causing a change in the pressure in the pressure chambers, whereby ink droplets are jetted.

The actuator of this prior art ink jet print head is formed by butt-bonding two types of piezoelectric elements, cutting grooves in the butt-bonded two types of piezoelectric elements to form the side walls, and forming the electrodes on the side walls by plating.

When the piezoelectric elements of the actuator are bonded together by a thick layer of an adhesive, the electrodes are formed with an uneven thickness because the material forming the electrodes is easy to deposit on the piezoelectric elements made of a ceramic material, but difficult to deposit on the adhesive layer made of a resin or the like and, therefore, the coverage of the films forming the electrodes is reduced. Consequently, the ability of the actuator is reduced, the jet velocity of the ink droplets is reduced, or the electrode extending across the two types of piezoelectric elements is disconnected to make ink jetting operation impossible.

SUMMARY OF THE INVENTION

The present invention has been made to solve the foregoing problems and it is therefore an object of the present invention to provide an ink jet print head comprising actuators having piezoelectric elements forming side walls, in which the piezoelectric elements are bonded together by a layer of an adhesive, and the layer of the adhesive is formed within a predetermined thickness range to prevent the reduction of the coverage of electrodes formed on the side walls of the actuators so that uniform ink droplet jetting performance can be secured.

According to the present invention, an ink jet print head intended for use on an ink jet printer which jets ink droplets for recording comprises: nozzles through which ink droplets are jetted; pressure chambers communicating with the nozzles, respectively, to supply a liquid to be jetted to the nozzles; actuators each comprising two types of piezoelectric elements polarized in opposite polarities and forming the side walls of the pressure chambers, and electrodes formed on the side walls to create an electric field perpendicular to the direction of polarization; and an ink supply for replenishing the pressure chambers with ink. The two types of piezoelectric elements are bonded together by an adhesive layer of a small thickness suitable for the electrodes to secure a coverage higher than a predetermined level.

When a voltage is applied across the electrodes formed on the side walls of the pressure chambers, the two types of piezoelectric elements undergo shear deformation. Consequently, the pressure in the pressure chambers changes to jet ink contained in the pressure chambers in ink droplets. Then, the ink supply device replenishes the pressure chambers with ink. Since the adhesive layer adhesively bonding together the two types of piezoelectric elements has a small thickness suitable for the electrodes formed on the side walls to secure a coverage not lower than a predetermined level, the electrodes formed on the side walls and extending across the two-types of piezoelectric elements will not be disconnected, so that the actuators secure desired characteristics, and the ink jetting performance will not be deteriorated.

In the ink jet print head of the present invention, the electrodes are formed on the side walls by plating. Although the material forming the electrodes is easy to deposit on the piezoelectric elements but difficult to deposit on the adhesive layer, the coverage of portions of the electrodes covering the adhesive layers is not reduced because the adhesive layers have a small thickness.

In the ink jet print head of the present invention, the thickness of the adhesive layers is 10 $\mu$m or less. Since the adhesive layers are formed in such a small thickness, the coverage of the electrodes formed on the side walls is higher than the predetermined level. Accordingly, the characteristics of the actuator will not be deteriorated and the reduction of ink droplet jetting velocity can be suppressed.

Because adhesive layers, which adhesively bond the two types of piezoelectric elements of the actuators of the ink jet print head of the present invention, each have a thickness in the predetermined thickness range, the coverage of the electrodes formed on the side walls of the actuators is not reduced and ink droplets can be uniformly jetted. The electrodes extending across the two types of piezoelectric elements will not be disconnected and, consequently, the reduction of ink jetting velocity and troubles that make ink jetting operation impossible can be prevented.

Furthermore, since the thickness of the adhesive layers of the ink jet print head of the present invention may be 10 $\mu$m or less, and is preferably 4 $\mu$m or less, the electrodes formed on the side walls can secure a sufficiently high coverage and, therefore, ink jetting velocity will not be reduced, and ink the jet print head is able to achieve high-quality printing operation.

These and other aspects and advantages will be described in or apparent from the following detailed description of preferred embodiments.

BRIEF DESCRIPTION OF THE DRAWINGS

Preferred embodiments of the present invention will be described in detail with reference to the following drawings, wherein.

DETAILED DESCRIPTION OF PREFERRED EMBODIMENTS

An ink jet print head in a preferred embodiment according to the present invention will be described hereinafter with reference to the accompanying drawings. The ink jet print head is intended for use on an ink jet printer. The ink jet print head has pressure chambers defined by side walls formed of piezoelectric elements and jets ink droplets by the agency of change in pressure in the pressure chambers caused by the shear deformation of the piezoelectric elements.

Figure 1:
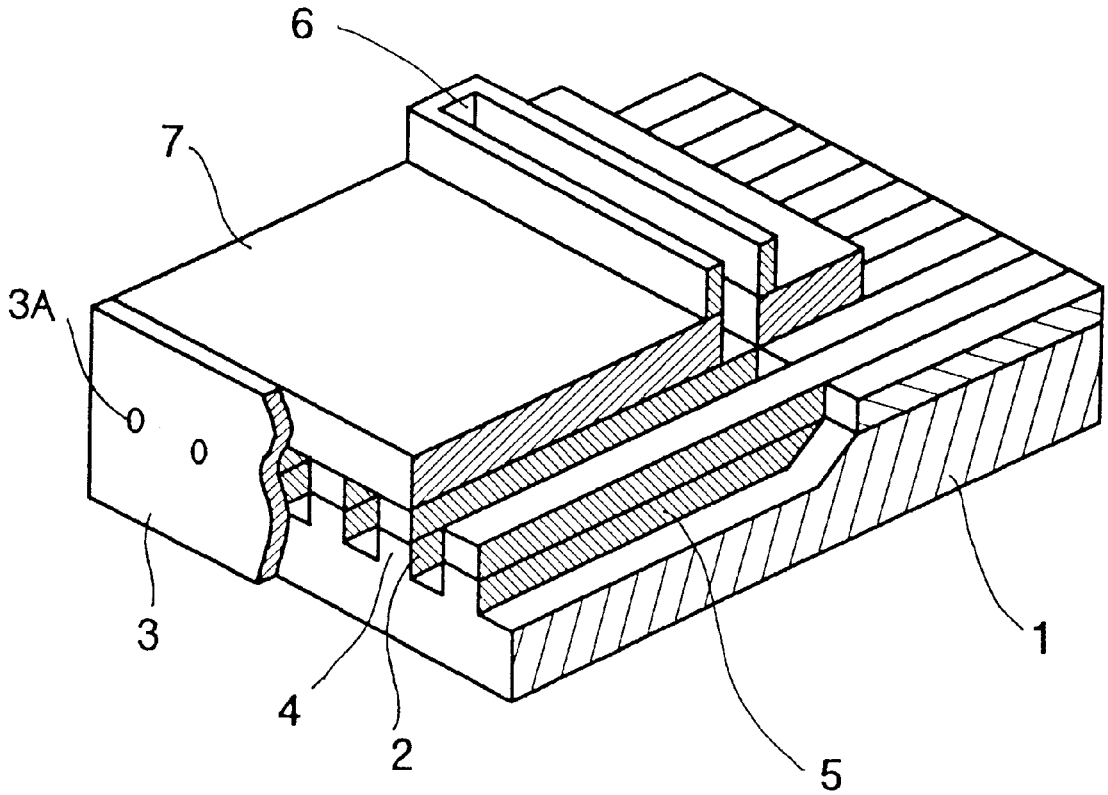
FIG. 1 is a partially cutaway perspective view of an ink jet print head in a preferred embodiment according to the present invention.

Referring to FIG. 1 showing the ink jet print head in a partially cutaway perspective view, parallel grooves for forming pressure chambers 2, i.e., ink chambers, are formed in a piezoelectric ceramic base plate 1 by dicing or the like. A nozzle plate 3 provided with nozzles 3A is attached to one end of the piezoelectric ceramic base plate 1 in which the pressure chambers 2 are formed. Each of piezoelectric side walls 4 defining the pressure chambers 2 includes two types of piezoelectric elements that are polarized in opposite polarities. An electrode 5 for creating an electric field perpendicular to the direction of polarization is formed over the surface of each piezoelectric side wall 4. A top cover 7 provided with an ink supply opening (ink supply means) 6 is attached to the upper surface of the piezoelectric ceramic base plate 1 to define the pressure chambers 2. The pressure chambers 2 are connected through the ink supply opening 6 to an ink cartridge (not shown). The pressure chambers 2 thus formed have a rectangular cross section surrounded by the piezoelectric side walls 4 and the top cover 7.

Figure 2:
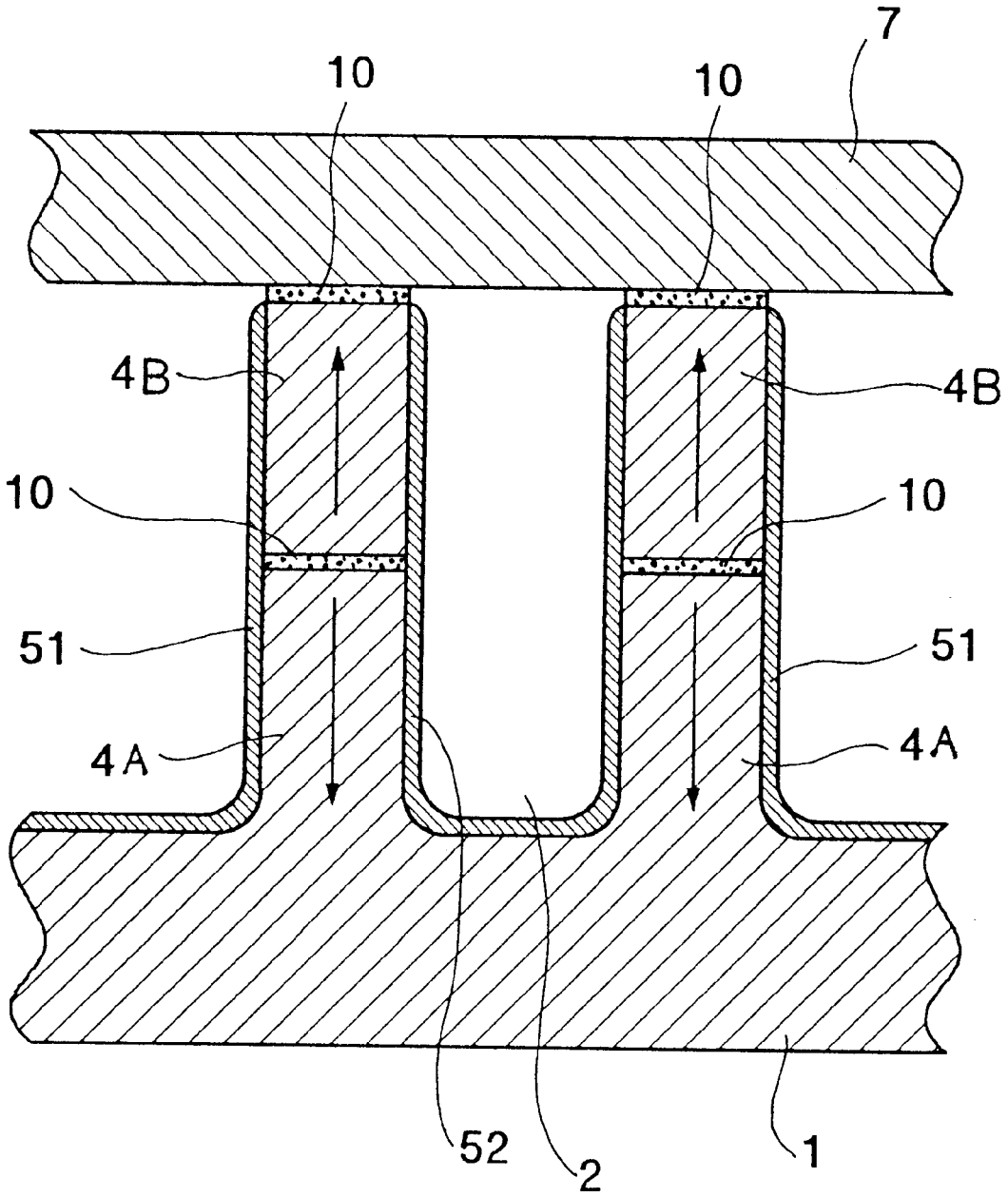
FIG. 2 is a fragmentary longitudinal sectional view of the ink jet print head of FIG. 1.

Referring to FIG. 2, the piezoelectric side wall 4 includes two types of piezoelectric elements 4A and 4B, and the electrodes 5 (51 and 52) are formed on the piezoelectric side wall 4. The piezoelectric side wall 4 and the electrodes 5 constitute an actuator. The directions of polarization of the piezoelectric elements 4A and 4B are indicated by the arrows. The electrodes 51 and 52 are formed by plating. The electrode 51 is connected to a positive potential and the electrode 52 is connected to a ground to apply an electric field to the piezoelectric elements 4A and 4B. The piezoelectric elements 4A and 4B are bonded together by an adhesive layer 10. The adhesive layer 10 is formed in a small thickness for reasons, which will be described later, so that the coverage of the electrodes 51 and 52 formed on the piezoelectric elements 4A and 4B is not lower than a predetermined level. The top plate 7 is bonded adhesively to the upper ends of the piezoelectric elements 4B by adhesive layers 10 of an epoxy adhesive.

The operation of the ink jet print head thus constructed will be described hereinafter. The ink jet print head is mounted on a carriage (not shown), and the carriage is reciprocated along a recording sheet, and voltage to be applied across the electrodes 51 and 52 is controlled according to print data (dot data) transferred from a host computer or the like through an interface to a print head driving unit (not shown) to actuate the actuators accordingly. Consequently, the piezoelectric elements 4A and 4B undergo shear deformation, pressures in the pressure chambers 2 are changed, whereby ink supplied from the ink cartridge into the pressure chambers 2 is jetted in ink droplets through the nozzles 3A for printing.

Figure 3A:
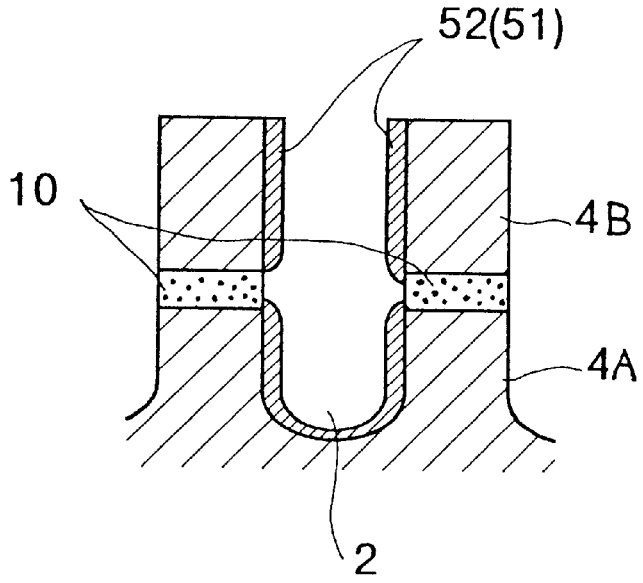
FIG. 3A is a sectional view of piezoelectric walls, typically showing an electrode formed on piezoelectric side walls formed by using adhesive layers having a big thickness, and having excessively thin portions corresponding to the adhesive layers.
Figure 3B:
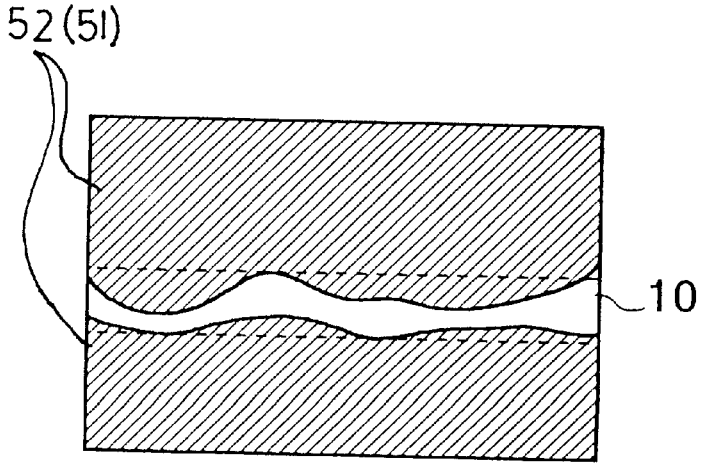
FIG. 3B is a side view of the piezoelectric side walls shown in FIG. 3A, typically showing an electrode formed on piezoelectric side walls formed by using adhesive layers having a big thickness, and having excessively thin portions corresponding to the adhesive layers.

The effect of the thickness of the adhesive layer 10 adhesively bonding together the piezoelectric elements 4A and 4B will be described with reference to FIGS. 3A and 3B, FIG. 4 and FIG. 5. As shown in FIGS. 3A and 3B, the thickness of portions of the electrode 51 (52) corresponding to the adhesive layers 10 is reduced when the adhesive layers 10 have a large thickness. When the electrode 51 (52) extending across the piezoelectric elements 4A and 4B has a low coverage as shown in FIGS. 3A and 3B, it is possible that the electrode 51 (52) is electrically disconnected and, consequently, the ink jetting velocity is reduced and, in the worst case, the ink jet print head becomes unable to jet ink droplets.

Figure 4:
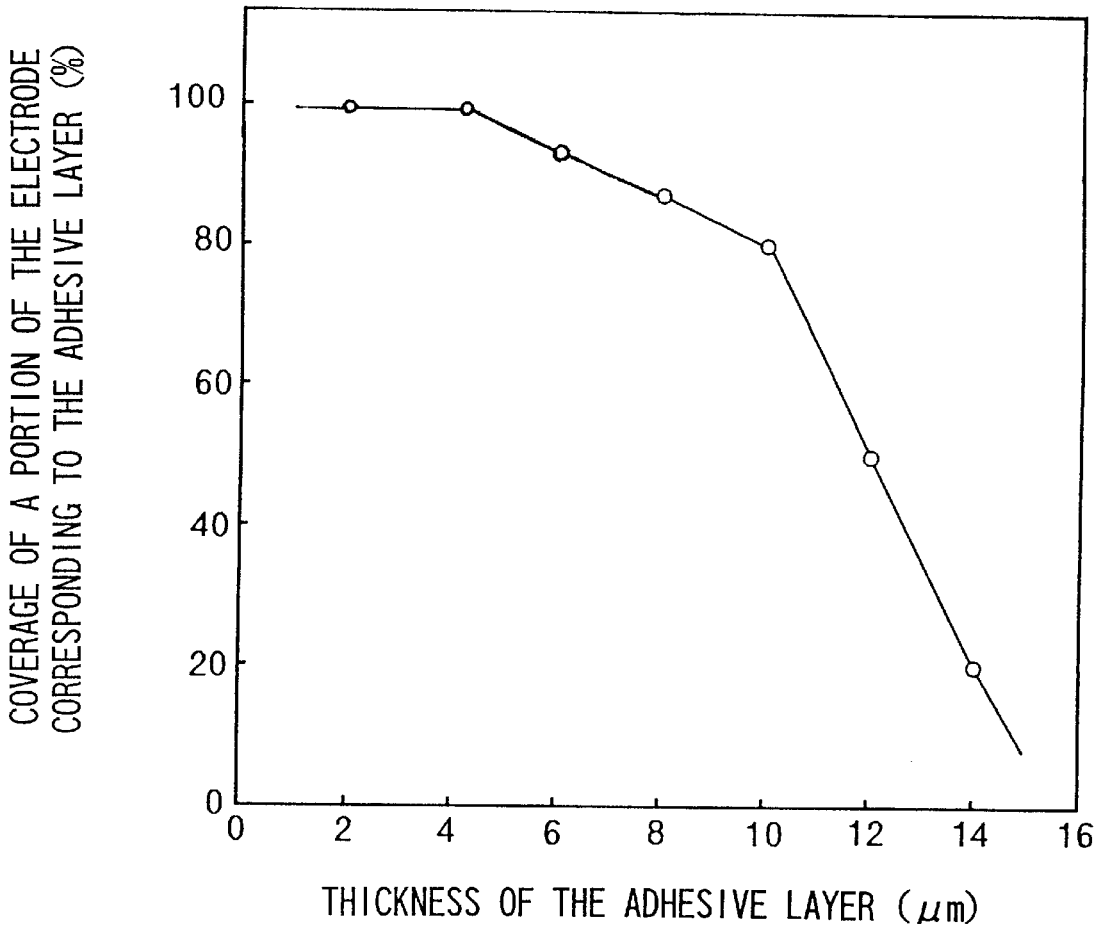
FIG. 4 is a graph showing the dependence of the coverage of a portion of an plated electrode corresponding to an adhesive layer on the thickness of the adhesive layer determined through experiments.

FIG. 4 is a graph showing the relationship between the coverage of a portion of the plated electrode 51 (52) corresponding to the adhesive layer 10 and the thickness of the adhesive layer 10, as determined through experiments. As is obvious from FIG. 4, the coverage decreases sharply when the thickness of the adhesive layer 10 increases beyond 10 $\mu$m. As shown, for a thickness of the adhesive layer of less than about 10 $\mu$m, a portion of the electrode corresponding to the adhesive layer has a coverage of at least about 80%. The thickness of the electrode 51 (52) is 1 $\mu$m.

Figure 5:
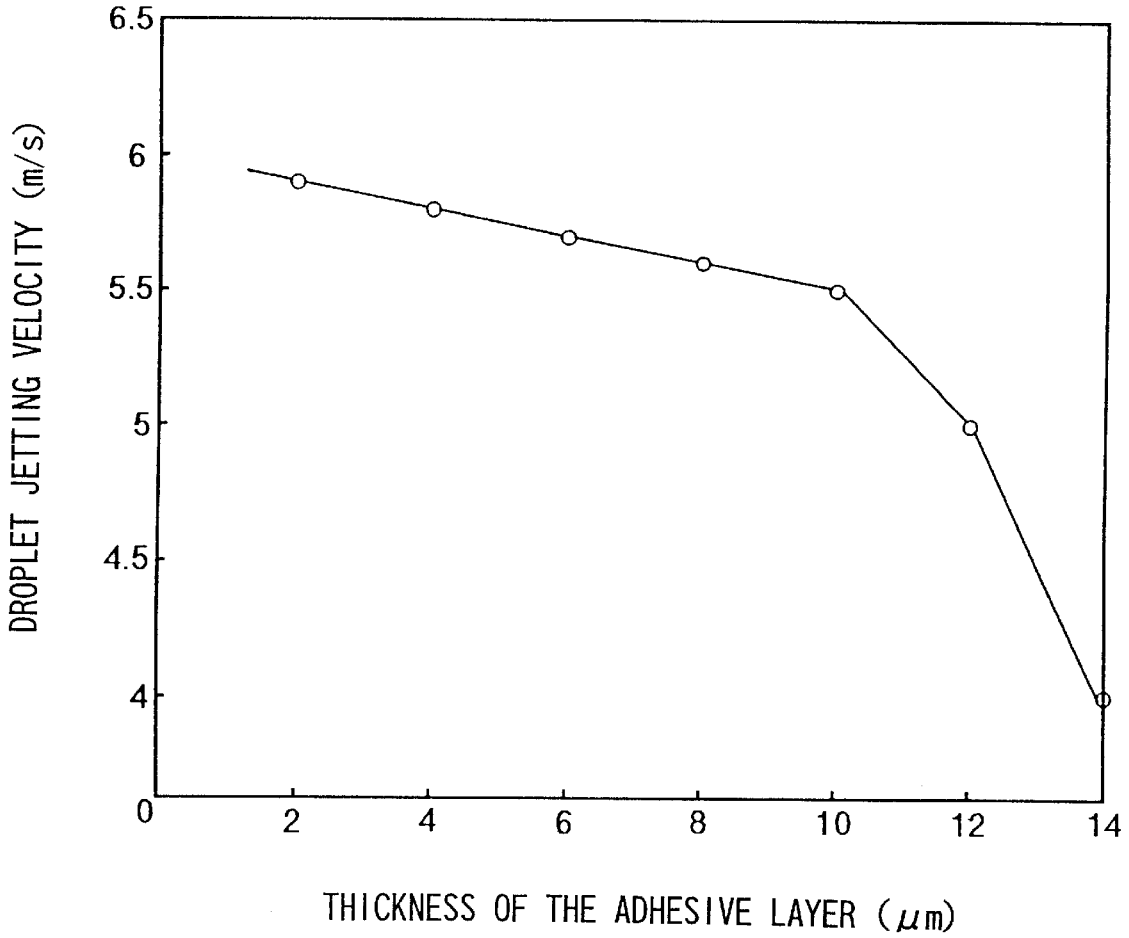
FIG. 5 is a graph showing the dependence of ink jet velocity on the thickness of an adhesive layer determined through experiments.

FIG. 5 is a graph showing the relationship between ink jet velocity and the thickness of an adhesive layer, as determined through experiments. As is obvious from FIG. 5, the ink jetting velocity decreases sharply when the thickness of the adhesive layer 10 increases beyond 10 $\mu$m. When the ink jetting speed changes by 10% or above from an appropriate ink jetting velocity, print quality is deteriorated. Thus it was found from the results of the experiments that a desirable thickness of the adhesive layers 10 is 10 $\mu$m or less. As shown, for a thickness of the adhesive layer of less than about 10 $\mu$m, the droplet jetting velocity is at least about 5.5 m/s. Since the particle size of the materials of the two types of piezoelectric elements 4A and 4B is in the range of about 1 to about 2 $\mu$m, the thickness of the adhesive layers 10 bonding together the piezoelectric elements 4A and 4B must be at least about 1 $\mu$m.

The present invention is not limited in its practical application to the foregoing embodiment and various modifications are possible. For example, although the adjacent pressure chambers 2 are formed adjacently on the opposite sides of the piezoelectric side wall 4 consisting of the piezoelectric elements 4A and 4B in this embodiment, non-jetting regions to which ink is not supplied may be formed on the opposite sides of each pressure chamber 2. The electrodes 51 and 52 need not be formed by plating on the piezoelectric side walls 4 each including the piezoelectric elements 4A and 4B; the electrodes 41 and 52 may be formed by a suitable metal thin film forming process, such as a vacuum evaporation process or a sputtering process.

What is claimed is:

1. An ink jet print head for use on an ink jet recording apparatus that jets ink droplets for recording, said ink jet print head comprising:

at least one nozzle through which ink droplets are jetted;

at least one pressure chamber communicating with the nozzle to supply a liquid ink to be jetted through the nozzle;

at least one actuator comprising a side wall including two piezoelectric elements having different directions of polarization, said side wall forming a side of said at least one pressure chamber;

at least one electrode formed on said side wall of said at least one actuator to apply an electric field to said side wall in a direction perpendicular to the directions of polarization of the piezoelectric elements;

a liquid supply communicating with said at least one pressure chamber for replenishing the pressure chamber with the liquid ink; and at least one adhesive layer adhesively bonding together the two piezoelectric elements of said side wall, said at least one adhesive layer having a thickness of not more than about 10 $\mu$m whereby a portion of said at least one electrode corresponding to said at least one adhesive layer has a coverage of said at least one adhesive layer not lower than about 80% in a thickness direction of said at least one adhesive layer.

2. The ink jet print head as claimed in claim 1, wherein said at least one electrode comprises an electro-plated electrode.

3. The ink jet print head as claimed in claim 1, wherein the thickness of said at least one adhesive layer is 4 $\mu$m or less.

4. The ink jet print head as claimed in claim 1, wherein the ink jetting velocity of the ink droplets through said at least one nozzle is at least about 5.5 m/s.

5. The ink jet print head as claimed in claim 1, wherein said ink jet print head comprises a plurality of actuators.

6. The ink jet print head as claimed in claim 1, wherein said portion of said at least one electrode corresponding to said at least one adhesive layer has a coverage of said at least one adhesive layer of about 100% in said thickness direction of said at least one adhesive layer.

7. An ink jet print head for use on an ink jet recording apparatus that jets ink droplets, said ink jet print head comprising:

at least one nozzle through which ink droplets are jetted;

at least one actuator comprising a side wall including two piezoelectric elements, said side wall forming a side wall of a pressure chamber through which ink is supplied to said at least one nozzle;

at least one electrode formed on said side wall to apply an electric field to the side wall; and an adhesive which bonds together the two piezoelectric elements of said side wall, said adhesive having a thickness of not more than about 10 $\mu$m wherein at least one of the following conditions is satisfied:

i) a portion of said at least one electrode that corresponds to said adhesive has a coverage of said adhesive not lower than about 80% in a thickness direction of said adhesive; or ii) an ink jetting velocity of liquid ink through said at least one nozzle is within a predetermined velocity range.

8. The ink jet print head as claimed in claim 7, wherein the adhesive bonding has a thickness of about 4 $\mu$m or less.

9. The ink jet print head as claimed in claim 7, wherein the ink jetting velocity of the ink droplets through said at least one nozzle is at least about 5.5 m/s.

10. The ink jet print head as claimed in claim 7, wherein said ink jet print head comprises a plurality of actuators.

11. The ink jet print head as claimed in claim 7, wherein said portion of said at least one electrode that corresponds to said adhesive has a coverage of said adhesive of about 100% in said thickness direction of said adhesive.

12. An inkjet print head for use on an ink jet recording apparatus that jets ink droplets, said ink jet print head comprising:

at least one nozzle through which ink droplets are jetted;

at least one actuator comprising a side wall including a plurality of piezoelectric elements, said side wall forming a side wall of a pressure chamber through which ink is supplied to said at least one nozzle;

at least one electrode formed on said side wall, to apply an electric field to the side wall; and an adhesive which bonds together the plurality of piezoelectric elements of said side wall, the adhesive having a thickness of not more than about 4 $\mu$m wherein the following conditions are satisfied:

i) a portion of said at least one electrode that corresponds to said adhesive has a coverage of said adhesive of about 100% in a thickness direction of said adhesive; and ii) an ink jetting velocity of liquid ink through said at least one nozzle is greater than 5.5 m/s.

* * * * *